US007914851B2

(12) United States Patent
Kim et al.

(10) Patent No.: US 7,914,851 B2
(45) Date of Patent: Mar. 29, 2011

(54) METHOD OF MANUFACTURING HOT-DIPPED GALVANIZED STEEL SHEET

(75) Inventors: Sang-Heon Kim, Kyungsangbook-do (KR); Noi-Ha Cho, Kyungsangbook-do (KR); Yeong-Sool Jin, Kyungsangbook-do (KR)

(73) Assignee: POSCO, Pohang (KR)

( * ) Notice: Subject to any disclaimer, the term of this patent is extended or adjusted under 35 U.S.C. 154(b) by 703 days.

(21) Appl. No.: 11/722,759

(22) PCT Filed: Oct. 31, 2005

(86) PCT No.: PCT/KR2005/003637

§ 371 (c)(1),
(2), (4) Date: Nov. 13, 2007

(87) PCT Pub. No.: WO2006/070995

PCT Pub. Date: Jul. 6, 2006

(65) Prior Publication Data

US 2008/0206592 A1 Aug. 28, 2008

(30) Foreign Application Priority Data

Dec. 28, 2004 (KR) ..... 10-2004-0114090

(51) Int. Cl.
*B05D 1/18* (2006.01)
*B05D 3/10* (2006.01)

(52) U.S. Cl. ..... 427/337; 427/347; 427/331; 427/398.1; 427/398.3; 427/431; 427/434.2; 427/435; 427/436

(58) Field of Classification Search ..... 427/430.1, 427/434.2, 435, 436, 331
See application file for complete search history.

(56) References Cited

U.S. PATENT DOCUMENTS 3,379,557 A * 4/1968 Hoover et al. ..... 427/353
(Continued)

FOREIGN PATENT DOCUMENTS

DE 2207603 A1 8/1973
(Continued)

OTHER PUBLICATIONS

Machine Translation, Niigashira et al., JP 08-188863, Jul. 1996.*
(Continued)

*Primary Examiner* — David Turocy
(74) *Attorney, Agent, or Firm* — The Webb Law Firm

(57) ABSTRACT

A spangle-free, hot-dip galvanized steel sheet, and a method and device for manufacturing the same. The hot-dip galvanized steel sheet is characterized in that a solidified zinc crystal of hot-dip galvanized layer has an average crystalline texture particle diameter of 10 to 88 μm and there is no solidification traces of dendrites upon observing under a microscope at a magnification of 100×. The method comprises dipping a steel sheet in a bath of a zinc-coating solution containing 0.13 to 0.3% by weight of aluminum; air-wiping the steel sheet to remove an excess of the coating solution; spraying water or an aqueous solution on the air-wiped steel sheet, using a steel sheet temperature in the range of a hot-dip galvanization temperature to 419 ° C. as a spray initiation temperature and using a steel sheet temperature in the range of 417 ° C. to 415 ° C. as a spray completion temperature; passing sprayed liquid droplets of water or aqueous solution through a mesh-like high-voltage charged electrode which is electrically charged with a high voltage of −1 to −50 kV; and allowing the electrode-passed liquid droplets to be bound to the surface of the steel sheet and hereby being served as solidification nuclei of molten zinc.

6 Claims, 6 Drawing Sheets

U.S. PATENT DOCUMENTS

| | | | | | |
|---|---|---|---|---|---|
| 3,712,826 | A | | 1/1973 | Kimuro et al. | |
| 4,020,792 | A | * | 5/1977 | Jordan | 118/629 |
| 4,383,006 | A | * | 5/1983 | Shindo et al. | 428/659 |
| 4,500,561 | A | * | 2/1985 | Kim et al. | 427/473 |
| 4,812,371 | A | | 3/1989 | Shindou et al. | |
| 4,819,879 | A | * | 4/1989 | Sharpless et al. | 239/691 |
| 5,222,663 | A | * | 6/1993 | Noakes et al. | 239/3 |
| 6,677,053 | B2 | | 1/2004 | Yamaji et al. | |

FOREIGN PATENT DOCUMENTS

| | | | | |
|---|---|---|---|---|
| EP | 1348773 | A1 | | 10/2003 |
| JP | 54160524 | A | | 12/1979 |
| JP | 57108254 | A | | 7/1982 |
| JP | 60181260 | A | | 9/1985 |
| JP | 62089856 | A | | 4/1987 |
| JP | 03260043 | A | | 11/1991 |
| JP | 07018399 | A | * | 1/1995 |
| JP | 8074018 | A | | 3/1996 |
| JP | 08188863 | A | * | 7/1996 |
| JP | 8188863 | A | | 7/1996 |
| JP | 11100653 | A | | 4/1999 |
| JP | 11124660 | A | | 5/1999 |
| JP | 2001303264 | A | | 10/2001 |
| JP | 2002256404 | A | * | 9/2002 |
| JP | 2003193215 | A | | 7/2003 |
| KR | 20010057547 | A | | 7/2001 |
| KR | 20010061451 | A | | 7/2001 |
| KR | 100380134 | B1 | | 4/2003 |

OTHER PUBLICATIONS

Machine Translation, Kim et al., KR 2001-0061451, Jul. 2001.*

* cited by examiner

[Fig. 1]
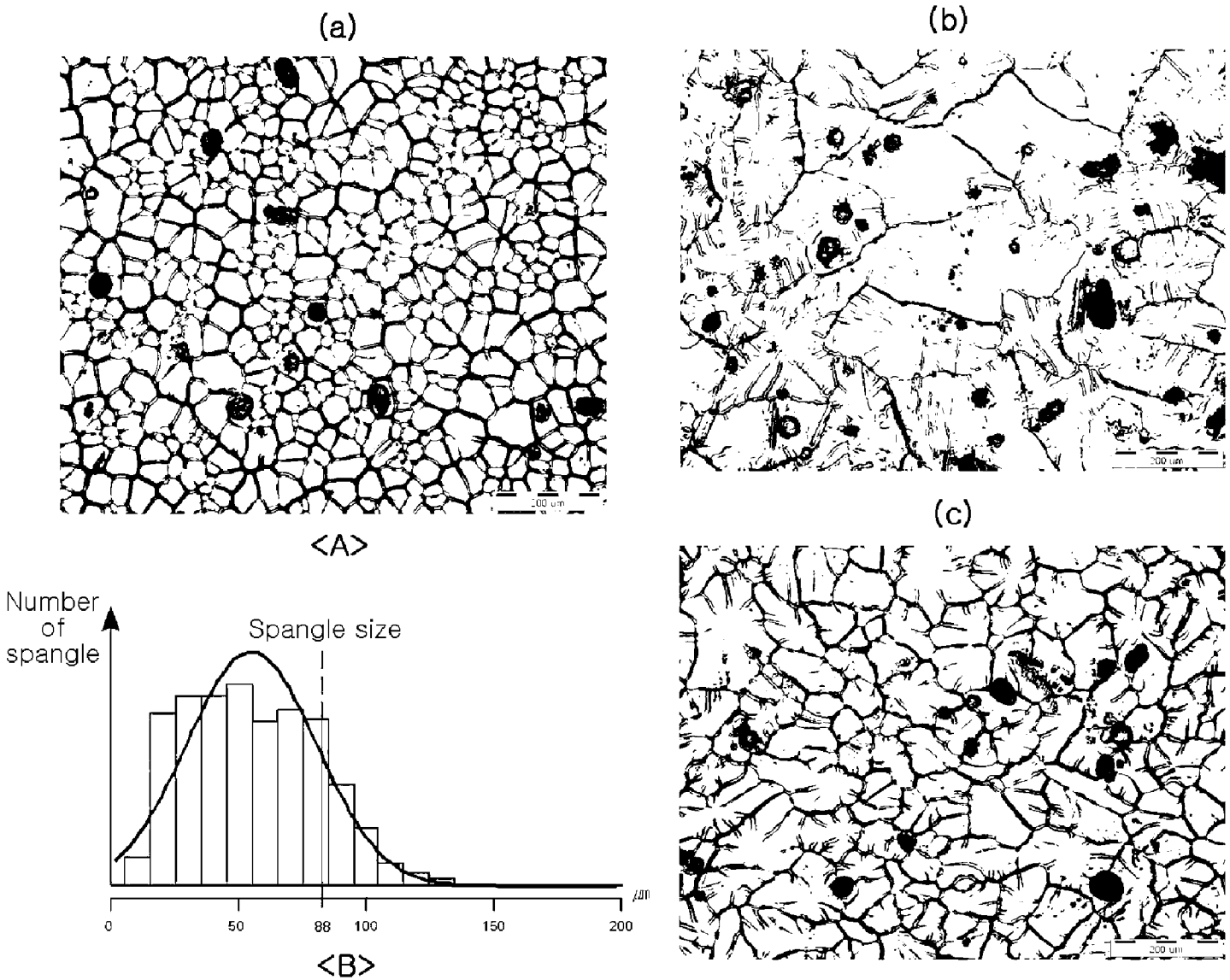

[Fig. 2]
(a)
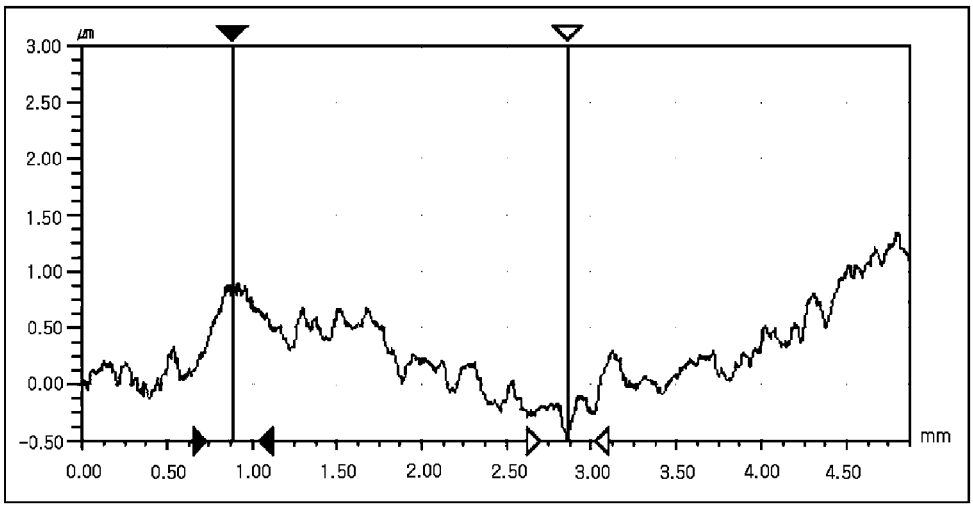
1.0 μm
(b)
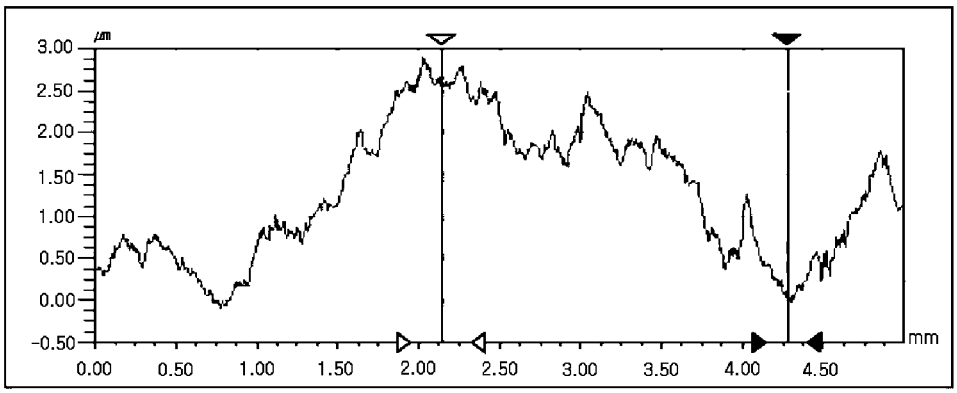
2.5 μm

[Fig. 3]
(a)
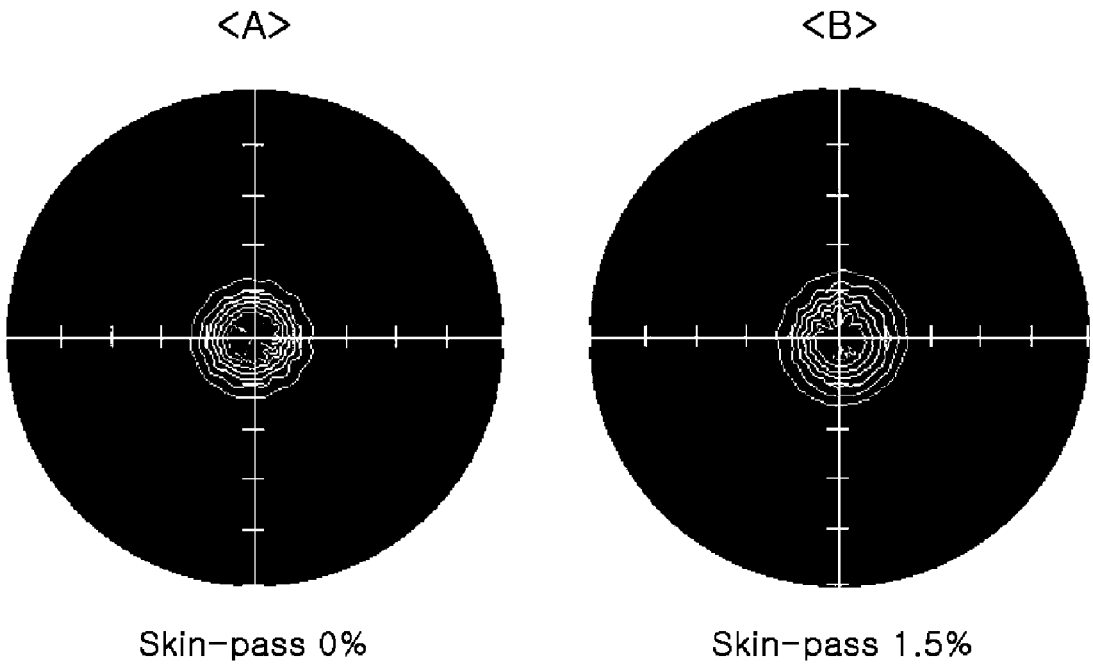
(b)
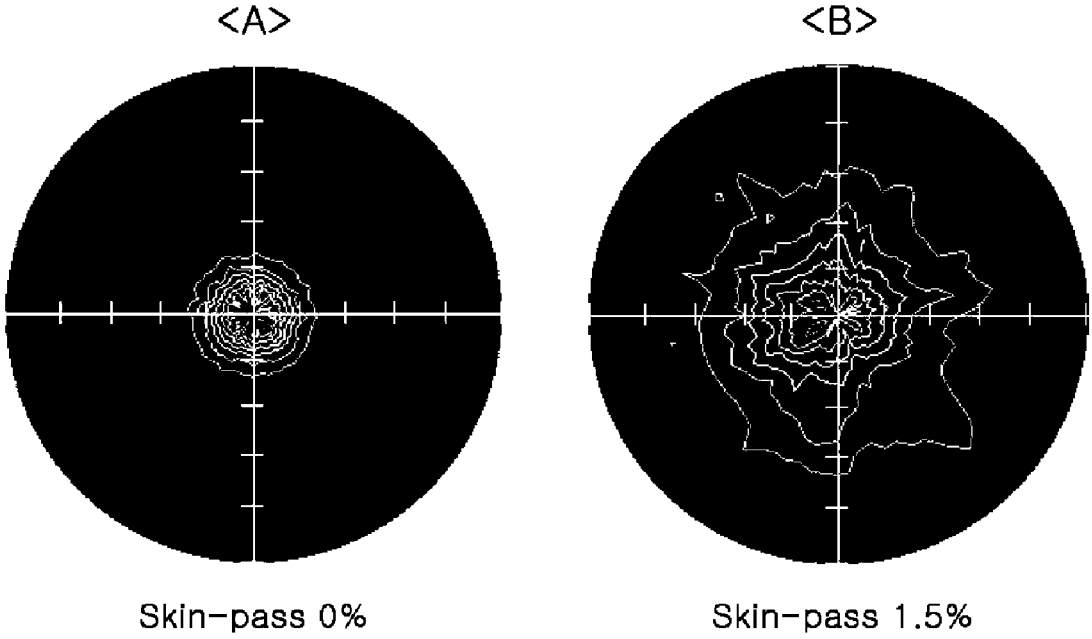

[Fig. 4]
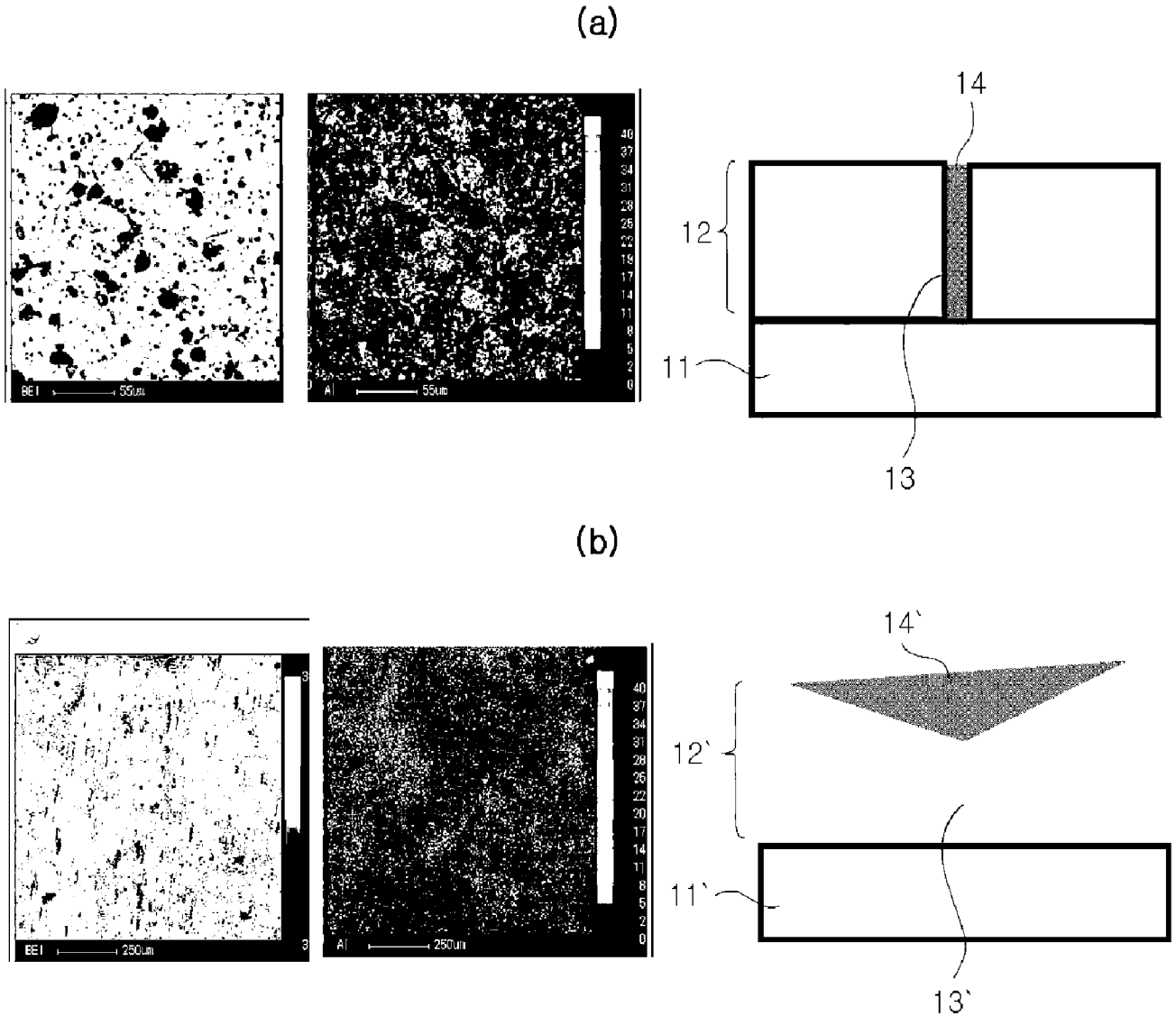

[Fig. 5]
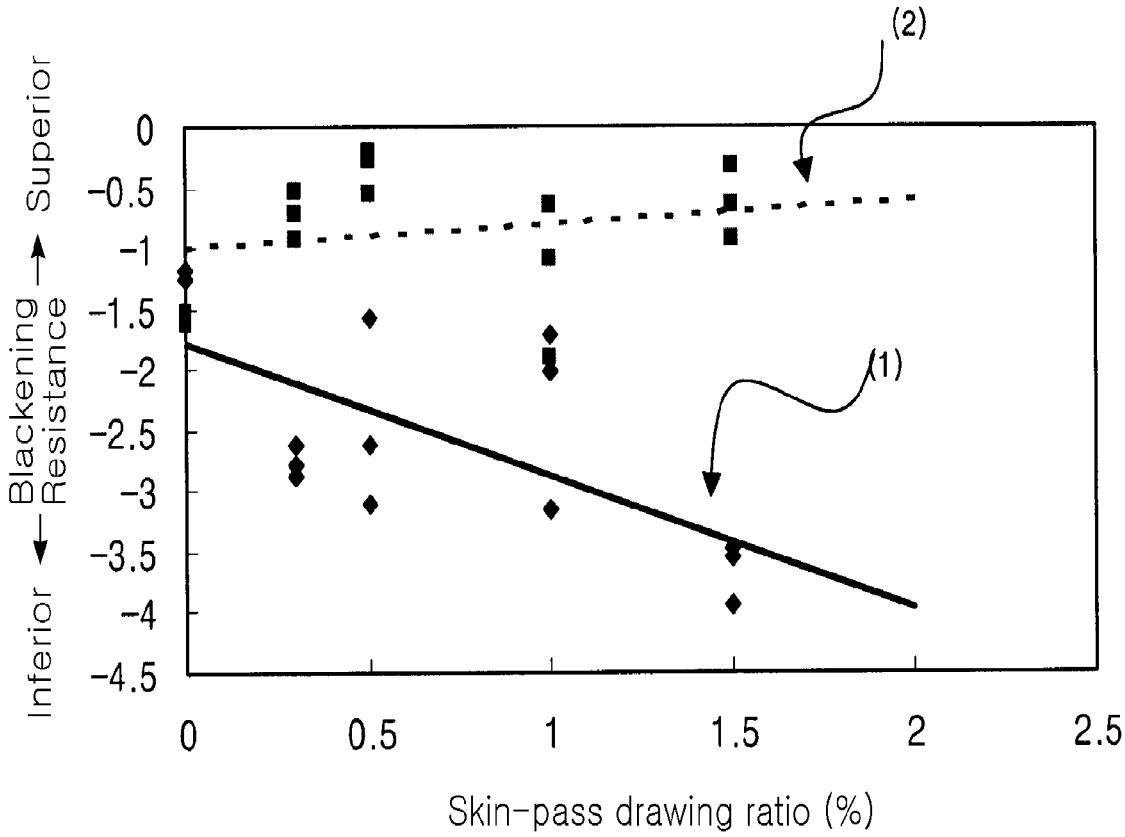

[Fig. 6]
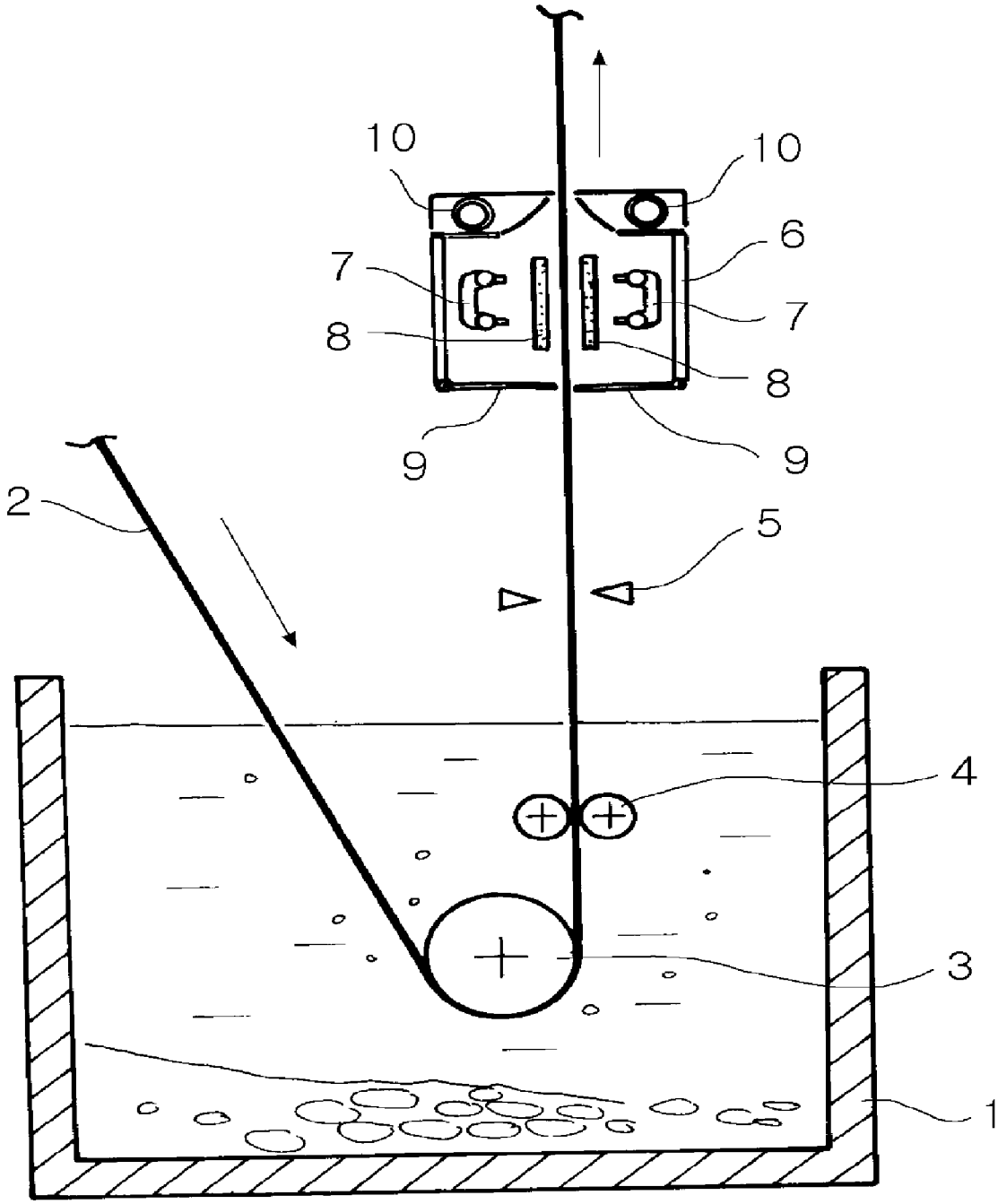

METHOD OF MANUFACTURING HOT-DIPPED GALVANIZED STEEL SHEET

TECHNICAL FIELD

The present invention relates to a spangle-free, hot-dip galvanized steel sheet, and a method and device for manufacturing the same. More specifically, the present invention relates to a spangle-free, hot-dip galvanized steel sheet having superior corrosion resistance, oil stain resistance and blackening resistance and exhibiting favorable surface appearance, and a method and device for manufacturing the same.

BACKGROUND ART

Hot-dip galvanized (HDG) steel sheets have advantages such as manufacturing compared to electrocoating and low costs of products and therefore their uses are recently extending to broad areas such as household electric appliances and motor vehicles. However, in spite of their low costs, the hot-dip galvanized steel sheets have surface qualities inferior to those of electro-galvanized (EG) steel sheets and therefore are not widely used for applications in which distinctness of image (DOI) or favorableness of external appearance after painting is a very important factor, such as outer plates of motor vehicles or household electric appliances. Further, hot-dip galvanized steel sheets suffer from problems and disadvantages such as inferior corrosion resistance, blackening resistance and oil stain resistance, as compared to electro-galvanized steel sheets.

As such, in compliance with their extended uses, the hot-dip galvanized steel sheets are required to have superior quality characteristics in conjunction with favorable surface appearance comparable to that of electro-galvanized steel sheets, and in particular, there are required improvements in surface appearance, oil stain resistance and blackening resistance, which are inferior to those of electro-galvanized steel sheets.

Disadvantageous properties of the hot-dip galvanized steel sheets such as inferior surface appearance, corrosion resistance, oil stain resistance and blackening resistance, as compared to those of electro-galvanized steel sheets, result from coating layer-formation reactions and manufacturing processes of the hot-dip galvanized steel sheets. In electro-galvanization, the coating layer is composed of fine crystalline grain. Whereas, the coating layer obtained by hot-dip galvanization is composed of large crystalline grains. As a result, there is a difference in grain boundary therebetween. That is, the coating layer obtained by electro-galvanization is made up of fine crystallines having a size of several μm to several tens of μm, whereas the coating layer of the hot-dip galvanized steel sheet is susceptible to occurrence of a unique coating texture aspect, called a spangle or flower pattern, and the coating texture of commercially available hot-dip galvanized steel sheets generally has a texture region size of more than 500 μm.

Occurrence of such coarse spangles is due to characteristics of solidification reaction of zinc. That is, when zinc is solidified, dendrites in the form of the branches of a tree rapidly grow from a solidification nucleus as a starting point at an early stage of solidification, forming a skeletal structure of the coating texture, and thereafter a non-solidified molten zinc pool, which remained between dendrites, solidifies, thus resulting in completion of solidification reaction. That is, it can be said that the size of spangles is dependent on the size of skeleton of the coating texture which was determined at the early stage of solidification.

Further, when dendrites grow, since they solidify while consuming molten zinc present therearound, a region of dendrites convexly protrudes and a region of the pool concavely depresses, thereby resulting in a non-uniform thickness of the coating layer, i.e., occurrence of hills and valleys on the coating surface.

Further, upon solidification of molten zinc, features and forms of spangles vary depending upon what manner hexagonal crystal structures of zinc are crystallographically arranged on the surface of the steel sheet. In other words, one hot-dip galvanized layer is composed of various forms of zinc crystals (spangles), thus representing that hexagonal crystal structures of zinc are placed at different angles according to respective regions of the coating layer. Generally, crystal orientation in which a basal plane of zinc is placed parallel to the surface of the steel sheet is known to exert the most superior corrosion resistance, blackening resistance and chemical stability, but it is very difficult to make all of the spangles to have desired basal planes.

Consequently, each and every spangle in one hot-dip galvanized steel sheet has different crystal planes of zinc exposed to the surface and there are differences in chemical reactivity according to respective regions due to non-uniformity of crystal orientation, which are believed to result in inferior corrosion resistance, oil stain resistance and blackening resistance of the hot-dip galvanized steel sheet as compared to electro-galvanized (EG) steel sheets having uniform surface texture.

Meanwhile, generally in corrosion, the exterior of grains, grain boundary, has a high electrochemical potential and thereby serves as an anode where corrosion proceeds, whereas the interior of grains serves as a cathode. Where the area of the anode is relatively small as compared to that of the cathode, corrosion locally and rapidly progresses.

In a hot-dip galvanization process, when skin-pass rolling for improving surface appearance via securing of mechanical properties and inhibition of spangle exposure is carried out, adverse effects such as non-uniformity of crystal structures and occurrence of coarse coating texture are more pronounced. That is, each spangle exhibits a different degree of deformation caused by rolling, and as a result, adverse effects due to non-uniformity of crystal structures become even worse. Further, as the coarse coating texture exhibits more conspicuous shapes of dendrites, there are significant unevenness of surface profile according to respective regions of the coating layer. As a result, regions protruded upon skin-pass rolling are mechanically further deformed, resulting in serious problems associated with heterogeneous qualities according to respective regions.

In order to solve the above-mentioned shortcomings due to spangles and in order to obtain qualities comparable to those of electro-galvanized steel sheets, it is necessary to micronize spangles to the maximum extent possible. For such reasons, a variety of methods for decreasing the spangle size have been proposed.

For example, mention may be made of the following methods: (1) Method using a coating bath to which antimony (Sb) or lead (Pb) is not added, (2) Method involving performing skin-pass rolling after coating is complete, and (3) Method involving spraying water or an aqueous solution immediately before solidification of the zinc-coating layer.

However, the coating methods (1) and (3) may reduce the size of spangles, but suffer from difficulty to achieve a decrease of the spangle size equal to the level of electrocoating, due to a high solidification rate of zinc. Hereinafter, the reasons for that will be specifically described.

The first reason is based on solidification properties of molten zinc. That is, the steel sheet has a thickness of about 0.4 to 2.3 mm, whereas the hot-dip galvanized layer typically has a thickness of about 7 to 10 μm and does not exceed a maximum of 50 m, which is very thin as compared to the steel sheet.

As such, when the coating layer is solidified while being cooled, solidification of the coating layer takes some period of time because the steel sheet has a large amount of latent heat stored therein. At this time, dendrites grow in the surface direction of the steel sheet. Therefore, spangles having a size of about 0.5 to 1 mm occur even with combined use of Method 1 and Method 3, and it has been regarded by consumers of the steel sheet that such a size is almost free of spangles and is sufficient to be used in desired applications.

For consumers requiring favorable surface appearance, it is necessary to completely remove traces of spangling. For this purpose, the steel sheet is prepared by increasing an amount of skin-pass rolling in Method (2). Here, the coating layer is crushed by skin-pass rolling, resulting in elimination of surface heterogeneity such as spangling, and thereby it is possible to achieve surface qualities similar to the level of the electroplated material to some extent. However, since the coating layer is deformed by mechanical force, more skin-pass rolling leads to poor blackening resistance, oil stain resistance and corrosion resistance, thus presenting a problem of short-term storage of the steel sheet.

As a method of reducing the spangle size by controlling the solidification reaction of the coating layer, there is a method of solidifying the coating layer by vigorously spraying an aqueous solution at relatively high-pressure or by spraying a finely divided zinc powder upon solidification of the coating layer. However, high-pressure spray is likely to result in damaged appearance due to marks pitted by impingement of sprayed liquid droplets of the aqueous solution on the zinc-coating layer in a molten state. In addition, spraying of zinc powder suffers from problems such as environmental contamination due to scattering of zinc dust inside plants and dent defects on the steel sheet caused by sticking of zinc powder, which was not completely fixed thereon, to various rolls.

As techniques relating to spangle-free hot-dip galvanized steel sheets and manufacturing methods thereof, reference may be made to Japanese Patent Laid-Open Publication Nos. 1999-100653, 1985-181260 and 1982-108254, Korean Patent Laid-Open Publication No. 2001-57547 and EP 1348773 A1, which disclose a galvanized steel sheet having a spangle size of 10 to 88 μm. However, there is no disclosure on hot-dip galvanized steel sheets having no traces of dendrite solidification, control of aluminum content in the coating layer and control of height differences between hills and valleys in the coating layer. In addition, Korean Patent Laid-Open Publication No. 61451 and U.S. Pat. No. 4,500,561 disclose a method for minimization of spangling on hot dip galvanized steel strip by forming an electric field and passing liquid droplets through the electric field, but do not mention about fabricating a charged electrode into a mesh shape.

Therefore, the present invention has been made in view of the above problems, and it is an object of the present invention to provide a hot-dip galvanized steel sheet having superior corrosion resistance, oil stain resistance and blackening resistance and exhibiting favorable surface appearance.

It is another object of the present invention to provide a spangle-free hot-dip galvanized steel sheet that can be used as a material for use in inner and outer plates of car body, household electric appliances and building materials and steel sheet for painting.

It is a further object of the present invention to provide a method of manufacturing a hot-dip galvanized steel sheet having superior corrosion resistance, oil stain resistance and blackening resistance and exhibiting favorable surface appearance.

It is yet another object of the present invention to provide a hot-dip galvanization hot-dip galvanized device for use in manufacturing a hot-dip galvanization steel sheet having superior corrosion resistance, oil stain resistance and blackening resistance and exhibiting favorable surface appearance.

SUMMARY OF THE INVENTION

In accordance with an aspect of the present invention, the above and other objects can be accomplished by the provision of a hot-dip galvanized steel sheet wherein a solidified zinc crystal of hot-dip galvanized layer has an average crystalline texture particle diameter of 10 to 88 μm, and there is no solidification traces of dendrites upon observing under a microscope at a magnification of 100×.

In accordance with another aspect of the present invention, there is provided a hot-dip galvanized steel sheet wherein a solidified zinc crystal of hot-dip galvanized layer has an average crystalline texture particle diameter of 10 to 88 μm and not less than 50% of aluminum (Al) on a surface layer portion of a coating layer is present around the grain boundary.

In accordance with a further aspect of the present invention, there is provided a hot-dip galvanized steel sheet wherein a solidified zinc crystal of hot-dip galvanized layer has an average crystalline texture particle diameter of 10 to 88 μm, and a height difference between hills and valleys formed on the coating layer in an arbitrarily selected circular area having a radius of 5 mm on the surface of the steel sheet is less than 25% of a coating thickness.

In accordance with yet another aspect of the present invention, there is provided a method of manufacturing a hot-dip galvanized steel sheet, comprising:

preparing a steel sheet for hot-dip galvanization;

dipping the steel sheet in a bath of a zinc-coating solution containing 0.13 to 0.3% by weight of aluminum;

air-wiping the steel sheet having the coating solution bound thereto, thereby removing an excess of the coating solution;

spraying water or an aqueous solution onto the surface of the air-wiped steel sheet, using a steel sheet temperature in the range of a hot-dip galvanization temperature to 419° C. as a spray initiation temperature and using a steel sheet temperature in the range of 417° C. to 415° C. as a spray completion temperature;

passing sprayed liquid droplets of water or aqueous solution through a mesh-like high-voltage charged electrode which is electrically charged with a high voltage of −1 to −50 kV; and allowing the electrode-passed liquid droplets to be bound to the surface of the steel sheet and thereby being served as solidification nuclei of molten zinc.

In accordance with a still further aspect of the present invention, there is provided a device for manufacturing a hot-dip galvanized steel sheet, comprising:

a pair of air knives positioned over a zinc-coating bath to control a coating amount of a plated steel sheet;

one or more water or aqueous solution-spray nozzles positioned toward the steel sheet in a spray bath over air knives; and a mesh-like charged electrode positioned between the spray nozzle and steel sheet.

BRIEF DESCRIPTION OF THE DRAWINGS

The above and other objects, features and other advantages of the present invention will be more clearly understood from the following detailed description taken in conjunction with the accompanying drawings, in which:

FIG. 1*a* (A) is a surface micrograph of a galvanized steel sheet in Example 5 (top) and (B) is a graph showing size distribution of spangles of galvanized steel sheet in Example 5 (bottom), respectively;

FIG. 1*b* is a surface micrograph of a zinc-galvanized steel sheet in Comparative Example 3;

FIG. 1*c* is a surface micrograph of a zinc-galvanized steel sheet in Comparative Example 9;

FIG. 2*a* is a graph showing results of determination on a degree of surface unevenness of a coating layer in Example 5;

FIG. 2*b* is a graph showing results of determination on a degree of surface unevenness of a coating layer in Comparative Example 3;

FIG. 3*a* is a graph showing a (0002) preferred orientation plane of a coating layer in Example 5;

FIG. 3*b* is a graph showing a (0002) preferred orientation plane of a coating layer in Comparative example 7;

FIG. 4*a* is an EM showing a segregation degree of aluminum in a coating layer of Example 5 (left), an EM showing results of analysis of a coating layer of Example 5 using an electron probe micro-analyzer(EPMA) (middle) and a view showing solidification behavior of a grain boundary in coating layer of Example 5 (right), respectively;

FIG. 4*b* is an EM showing a segregation degree of aluminum in a coating layer of Comparative Example 7 (left), an EM showing results of analysis of a coating layer of Comparative Example 7 using EPMA (middle) and a view showing solidification behavior of a grain boundary in coating layer of Comparative Example 7 (right), respectively;

FIG. 5 is a graph showing changes in blackening resistance of steel sheets of Example 5 and Comparative Example 7 with respect to variation of a skin pass drawing ratio; and FIG. 6 is a schematic view of a hot-dip galvanization device in accordance with the present invention.

BEST MODE FOR CARRYING OUT THE INVENTION

From examination of relationship between an average crystalline texture particle diameter of a hot-dip galvanized layer and qualities and surface appearance of a steel sheet, it was found that the steel sheet has the appearance of a favorable surface when the average crystalline texture (spangle) particle diameter of a solidified zinc crystal of a zinc galvanized layer becomes small in a range of not more than 88 μm which is a resolution limit of object recognition by naked eyes. The reason why such characteristics appear is because differences in scattering and reflection phenomena of light due to differences between grains in coating layer are not recognized by naked eyes, when the solidified zinc crystal of coating layer has an average crystalline texture grain size of not more than 88μm.

Therefore, electro-galvanized (EG) steel sheets made up of microcrystalline zinc grains presents difficulty to distinguish differences between grains in coating layers via naked eyes, whereas it is possible to distinguish such differences in conventional hot-dip galvanized steel sheets made up of macrocrystalline zinc grains and as a result, the surface of the coating layer has the feeling of non-uniformity due to differences in light reflection between grains in the hot-dip galvanized layer. However, the inventors of the present invention have discovered that when a spangle size in the zinc-galvanized layer is decreased to a range of not more than 88 μm, i.e., spangles disappear, there is a critical grain size at which characteristics such as corrosion resistance, blackening resistance and oil stain resistance are sharply improved.

That is, the hot-dip galvanized steel sheet, in which the average crystalline texture particle diameter (hereinafter, also referred to as "average texture size or spangle size") of a solidified zinc crystal of hot-dip galvanized layer is in a range of 10 to 88 μm, and solidification traces of dendrites are not observed under a microscope at a magnification of 100×, exhibits superior blackening resistance, oil stain resistance, corrosion resistance and surface appearance.

Although it is preferred to reduce a size of the coating texture to the maximum extent possible since a smaller size of the coating texture leads to tendency of improvements in surface appearance, corrosion resistance, blackening resistance and oil stain resistance even in a range of coating texture limited by the present invention, there is substantially no further improvement in such characteristics at a spangle size of less than 10 μm. In addition, micronization of the zinc grain involves increased numbers of spray nozzles, an increased concentration of an aqueous phosphate solution and intensification of applied high-voltage, thus imposing heavy burdens on manufacturing processes. Therefore, where the spangle size is less than 10 μm, an efficiency of a coating layer-formation process is deteriorated. In contrast, where the spangle size exceeds 88 μm, differences in scattering and reflection phenomena of light due to differences between zinc grains are recognized by naked eyes, as discussed above. Thus, it is impossible to obtain improved effects of corrosion resistance, blackening resistance, oil stain resistance and surface appearance.

Hereinafter, the construction and effects of the present invention will be described in more detail via physicochemical phenomena of a coating layer appearing when a coating texture becomes smaller.

As discussed hereinbefore, a grain boundary has a high electrochemical potential in corrosion, and thereby serves as an anode. As a crystal size becomes smaller, an area of the grain boundary is increased, thus representing that the area of anode in corrosion is increased.

As such, although the small area of anode results in local corrosion, it is possible to prevent such local corrosion by increasing the area of anode. Therefore, when the coating texture is micronized, zinc is uniformly consumed and it is thereby possible to prevent the steel sheet from being locally exposed to the atmosphere, thus improving corrosion resistance. That is, as the area of anode to be corroded is increased, the coating layer can be uniformly corroded.

Meanwhile, the dendrite refers to a coating texture skeleton which is formed in the form of the branches of a tree from solidification nucleus as a starting point when zinc solidifies. Generally, a pool of non-solidified molten zinc, which remained between dendrites, is finally solidified, thereby resulting in completion of solidification of the coating layer. Further, upon growing, since dendrites solidify while consuming molten zinc present therearound, the dendrite region convexly protrudes and the molten zinc pool region concavely depresses, thereby resulting in formation of a non-uniform coating layer. Then, such non-uniformity leads to differences in chemical reactivity according to respective regions and failure to obtain the hot-dip galvanized steel sheet having uniform corrosion resistance, oil stain resistance and blackening resistance and favorable appearance of surface texture. However, since the hot-dip galvanized steel sheet in accordance with the present invention is controlled to a state where no solidification traces of dendrites are present upon observing under a microscope at a magnification of 100×, the coating layer is uniformly formed, which results in uniform chemical reactivity throughout the coating layer, and as a result, the steel sheet displays improved corrosion resistance, oil stain resistance and blackening resistance, and favorable surface appearance.

In addition, if solidification proceeds in a manner that dendrites grow, it is difficult to obtain the coating texture having a size of not more than 88 μm, due to a very high growth rate of the dendrites, but less solidification traces of dendrites increases the possibility of obtaining finer zinc grain.

In another embodiment of the present invention, there is provided a hot-dip galvanized steel sheet in which the average crystalline texture particle diameter of a solidified zinc crystal of hot-dip galvanized layer exhibiting superior corrosion resistance, oil stain resistance and blackening resistance and favorable surface appearance is in a range of 10 to 88 μm and not less than 50% of aluminum (Al) in a surface layer portion of a coating layer is in the vicinity of the grain boundary.

That is, in the hot-dip galvanized steel sheet in accordance with the present invention, the average texture size of the coating layer is in a range of 10 to 88 μm and a certain portion of aluminum (Al) present in a surface layer portion of the coating layer should be segregated in the vicinity of grain boundaries. Aluminum having high corrosion resistance is largely distributed around grain boundaries, leading to stabilization of grain boundaries, and thus serves to inhibit corrosion of grain boundaries.

An increase in corrosion resistance exerted by aluminum in the hot-dip galvanized layer can be seen from the fact that Galfan or Galvalume, which is a zinc/aluminum alloy, is used in applications requiring high corrosion resistance. In addition, in conventional zinc-galvanized steel sheets, an improvement of corrosion resistance by aluminum can be confirmed from the fact that aluminum-added hot-dip galvanized steel sheets exhibit corrosion resistance superior to electro-galvanized steel sheets. Upon considering such improved corrosion resistance of zinc by aluminum, it can be seen that aluminum stabilizes unstable electrochemical properties of the grain boundaries, thereby improving corrosion resistance.

Accordingly, where aluminum (Al) in a surface layer portion of the coating layer, except for an iron/aluminum alloy phase, is present in an amount of 50% or more, preferably 95% or more at the grain boundaries, superior corrosion resistance is exerted. Herein, % content of aluminum present at the grain boundaries among the surface layer portion of the coating layer refers to % distribution of aluminum present at the grain boundaries among total aluminum distribution observed in the surface layer portion of the coating layer. Where the content of aluminum at the grain boundaries is less than 50%, it is undesirable in that there is no electrochemically stabilizing effect of aluminum on the grain boundaries. As high % of aluminum at the grain boundaries leads to an increase in corrosion resistance, an upper limit of aluminum components present at the grain boundaries is not particularly limited. According to experiments, a smaller size of crystalline texture leads to an increase in the aluminum content present at the grain boundaries, and where a size of the coating texture exceeds 88 μm, the aluminum content at the grain boundaries becomes less than 50%.

Without wishing to be bound to any particular theory, it is believed that the reason why large quantities of aluminum are present at the grain boundaries is due to the solidification reaction which will be described below.

Since zinc and aluminum contained in the coating layer, upon solidification, results in eutectic reaction, a higher content of aluminum lowers a solidification point of the coating layer. That is, a zinc alloy, in which aluminum is partially contained, results in lowering of the solidification point thereof as compared to pure zinc and upon solidification, proceeds with solidification in a manner that pure zinc is firstly crystallized and then a homogeneous atom, aluminum, is continuously pushed into a liquid phase. As a result, large amounts of aluminum are segregated at the grain boundaries where the latest solidification takes place. Here, as described above, aluminum present at the grain boundaries improves corrosion resistance of the unstable grain boundaries, thus resulting in uniform and improved corrosion resistance throughout the coating layer. By the way, upon development of dendrites, they are formed first and as a result, aluminum does not migrate from the initial nucleation sites to the grain boundaries but aluminum is trapped between arms of dendrites. Consequently aluminum cannot be present at the grain boundaries and is present in the pool of molten zinc formed between dendrites. In this case, stabilization effects of the grain boundaries by aluminum cannot be obtained as described above, and corrosion resistance is then deteriorated. However, since the hot-dip galvanized steel sheet in accordance with the present invention refers to a steel sheet that contains a small amount of molten zinc pool due to a small spangle size and no growth traces of dendrites, aluminum is enriched at the grain boundaries upon solidification and the grain boundaries are finally solidified. Hence, in order to ensure that aluminum is distributed at the grain boundaries, it is advantageous when dendrites are not observed in the coating texture and the size of the coating texture is smaller.

In a further embodiment of the present invention, there is provided a hot-dip galvanized steel sheet wherein an average texture size of a hot-dip galvanized layer having superior corrosion resistance, oil stain resistance and blackening resistance and favorable surface appearance is in a range of 10 to 88 μm, and a height difference between hills and valleys formed on the coating layer in an arbitrarily selected circular area having a radius of 5 mm on the surface of the steel sheet is less than 25% of a coating thickness.

Solidification traces of dendrites, when they are solidified, occur due to particular crystal planes and crystal directions at which solidification nuclei preferentially grow. When dendrites grow, since solidification of dendrites progresses in the thickness direction of the coating layer and the direction parallel to the surface of the steel sheet while consuming molten zinc present therearound, the point where solidification of dendrites is first initiated takes a convex shape ("↗",), whereas the grain boundary, which corresponds to a pool of molten zinc which is finally solidified, takes a concave shape (凹), which may result in unevenness of surface profile. Increases in unevenness on the surface of the coating layer may cause the problems which will be illustrated hereinafter.

In the hot-dip galvanized steel sheets, skin-pass rolling is usually carried out after solidification of the coating layer. Skin-pass rolling is performed in order to improve surface mechanical properties, remove surface defects, impart uniform surface roughness and improve steel sheet flatness.

Usually, where skin-pass rolling is performed, minute spot-like surface defects such as dross are not discernible by naked eyes, due to surface roughness-conferring effects by skin-pass rolling. However, where minute unevenness is present on the coating layer, such surface unevenness is further revealed by skin-pass rolling and thus surface appearance having the feeling of inferiority may be formed on the coating layer.

Occurrence of non-uniform appearance following skin-pass rolling may be due to non-flatness of the steel sheet, but surface defects, called flow marks and check marks, result from minute differences in degrees of skin-pass rolling according to respective regions because there is the presence of unevenness on the surface of the coating layer.

That is, if skin-pass rolling is not carried out, it is difficult to observe differences in scattering and reflection of light due to minute unevenness by naked eyes. Whereas, if skin-pass rolling is carried out, this may lead to non-uniformity in surface roughness and therefore the respective regions may be viewed differently and may have the feeling of non-uniform appearance.

In other words, if local unevenness occur in the depth direction of the surface of the coating layer, roughness imparted by skin-pass rolling is different according to respective regions. Hence, differences occur in reflection properties of light and such differences appear as superficial defects. That is, the convex ("↗",) region protruded from the surface of the coating layer is subject to a large amount of skin-pass rolling, which results in a rough surface, thereby lowering gloss and increasing whiteness. Whereas, the concave (凹) region, which is subject to less skin-pass rolling, exhibits high gloss and low whiteness. Occurrence of differences in glossiness and whiteness according to respective regions throughout the surface of the steel sheet provides the feeling of overall non-uniformity, thereby deteriorating the grade of external appearance.

However, in the hot-dip galvanized steel sheet in accordance with the present invention wherein an average texture size of hot-dip galvanized layer is in a range of 10 to 88 μm, and a height difference between hills and valleys formed on the coating layer in an arbitrarily selected circular area having a radius of 5 mm on the surface of the steel sheet is less than 25% of a coating thickness, occurrence of flow marks or surface defects after skin-pass rolling is significantly reduced.

That is, where the unevenness degree of coating layer is not less than 25% of the coating thickness, skin-pass rolling leads to locally non-uniform roughness of the coating layer, thereby resulting in poor surface appearance. In contrast, as the unevenness degree of coating layer becomes smaller, the coating layer exhibits superior physical properties such as favorable surface appearance, and high corrosion resistance, oil stain resistance and blackening resistance. Where the unevenness degree of coating layer is less than 25% of the coating thickness, it is difficult to recognize non-uniformity of roughness by naked eyes even when non-uniform roughness after skin-pass rolling occurs due to differences in thicknesses of the coating layer, and thereby the coating layer is recognized to have uniform appearance.

Additionally, in many cases of hot-dip galvanized steel sheets, crystal lattice planes usually exhibit preferred orientation of (0002) plane. As the (0002) plane exhibits superior corrosion resistance and blackening resistance, it is advantageous to have preferred orientation of (0002) plane in terms of quality. Meanwhile, when it is skin-pass rolled, the zinc-galvanized texture is deformed by mechanical force and thereby preferred orientation of (0002) plane is broken as an amount of skin-pass rolling is increased. However, where the spangle size is not more than 88 μm and the unevenness degree of coating layer is less than 25% of the coating layer thickness, preferred orientation of (0002) plane is not impaired even with skin-pass rolling and preferred orientation prior to skin-pass rolling is maintained.

These results represent that deformation of the coating texture occurs less by skin-pass rolling as the coating texture becomes smaller. Such phenomena is believed to be due to the fact that deformation in the coating texture was small due to a small amount of unevenness in the coating layer and deformation upon skin-pass rolling took place along the grain boundaries.

It is preferred that less amounts of zinc grains having a spangle size exceeding 88 μm are present in the coating layer of the hot-dip galvanized steel sheet in accordance with the present invention, but an amount of spangles exceeding 88 μm in a particle diameter may be permitted within a range of 10% and preferably 5%. However, if the amount of spangles is greater than the above range, this may result in problems associated with degradation of corrosion resistance, oil stain resistance and blackening resistance, and deterioration of surface appearance.

Further, the surface layer portion of the coating layer preferably contains phosphorus in an amount of 0.1 to 500 mg/m$^2$. Where the content of phosphorus is less than 0.1 mg/m$^2$, a binding amount of phosphorus which plays an important role in creation of solidification nuclei is too small, thereby leading to failure in micronization of the coating texture. In contrast, where the content of phosphorus exceeds 500 mg/m$^2$, the binding amount of phosphorus is too large, thereby resulting in a high risk of adverse effects on phosphate treatment performance in a painting process of motor vehicles.

The hot-dip galvanized steel sheet in accordance with the present invention having the coating texture as described above can be manufactured as follows.

In general, when a zinc-galvanized layer in a molten state is cooled, the coating layer is solidified through a process in which solidification nuclei are produced and the nuclei grow. Therefore, in order to hot-dip galvanize a steel sheet such that the spangle-free hot-dip galvanized steel sheet in accordance with the present invention is obtained, it is necessary to accelerate formation of the solidification nuclei and inhibit growth thereof in the solidification reaction. That is, solidification should be completed under conditions that a density of the solidification nuclei is increased in a solidification reaction step of the coating layer and dendrites are not developed and grown. According to the present invention, in order to secure large amounts of solidification nuclei and prevent development and growth of dendrites, the density of the solidification nuclei is increased by spraying water or an aqueous solution on the surface of the steel sheet. Further, liquid droplets of the aqueous solution are passed through a mesh-like high-voltage charged electrode which is electrically charged with a high voltage of −1 to −50 kV, thereby increasing the density of the solidification nuclei. That is, due to application of high-voltage, the aqueous solution is sprayed in the form of a multitude of small liquid droplets which are then bound to the steel sheet, and the small liquid droplets serve as solidification nuclei, thereby resulting in an increased density of solidification nuclei. Consequently, a solidification rate increases and dendrites do not develop, thereby resulting in formation of particulate fine texture.

In a manufacturing method of a hot-dip galvanized steel sheet in accordance with one embodiment of the present invention, a steel sheet for hot-dip galvanization is first prepared and is dipped in a bath of a zinc-coating solution containing 0.13 to 0.3% by weight of conventional aluminum. Kinds of the steel sheets are not particularly limited and therefore any steel sheets which are known to be commonly used in hot-dip galvanization can be used in the present invention. After dipping the steel sheet in the zinc-coating solution bath, the coating solution excessively bound to the steel sheet is removed and the steel sheet is air-wiped to control a coating amount. The coating amount may be generally controlled by consumers of the steel sheet, if necessary. Although the coating amount is not particularly limited, it is adjusted to a range of about 40 to 300 g/m$^2$ in terms of zinc/m$^2$ of one side of the steel sheet.

Thereafter, spraying of water or aqueous solution is initiated at the temperature of the air-wiped steel sheet and is continued until the steel sheet is cooled to at least 417° C. That is, water or aqueous solution is sprayed onto the surface of the air-wiped steel sheet, using a steel sheet temperature in the range of a hot-dip galvanization temperature to 419° C. as a spray initiation temperature and using a steel sheet temperature in the range of 417° C. to 415° C. as a spray completion temperature. This is because, in order to facilitate formation of solidification nuclei, it is effective to impart solidification nuclei from an external source. Spraying of water or aqueous solution is preferably initiated at a steel sheet temperature in a range of a hot-dip galvanization temperature to 417° C., preferably 460° C. to 419° C., more preferably 430° C. to 419° C., and most preferably 420° C. to 419° C. As used hereinbefore, the term hot-dip galvanization temperature refers to a temperature of the steel sheet which was air-wiped in a coating process. By spraying water or aqueous solution on the steel sheet from the point of hot-dip galvanization temperature, the steel sheet is cooled and molten zinc is solidified. However, according to experiments, only the liquid droplets, which were bound at the steel sheet temperature of about 419° C., can serve as solidification nuclei, whereas water or aqueous solution, which was sprayed on the steel sheet before or after the molten zinc began to solidify, merely plays a role to take heat capacity from the steel sheet. Therefore, in order to form a multitude of solidification nuclei, it is essential to spray water or aqueous solution on the steel sheet at near 419° C. That is, if the temperature of the steel sheet at the initiation point of solution spraying is lower than 419° C., the coating texture becomes large and there is a risk traces of dendrites will occur. However, since it is difficult to precisely determine a temperature of the steel sheet under production, although it is safe to spray the solution at a temperature of 419° C. or higher at which point the zinc is in a completely molten state because coarsening of the coating texture can be prevented, it is preferred to render the spray temperature as close to 419° C. to the maximum extent possible. Further, if spraying of the solution is stopped when the temperature of the steel sheet is higher than 417° C., there is a risk of remelting of solidification nuclei which were already produced. Therefore, upon cooling to a maximum of 415° C., sufficient solidification and cooling are effected and spraying of water or aqueous solution is completed. Most preferably, spraying is finished at the temperature of the steel sheet of about 417° C.

It is important to bind large numbers of liquid droplets to the steel sheet per unit area of the steel sheet in the above spray initiation and completion temperature ranges. Upon considering this point, it is advantageous to spray small-sized liquid droplets rather than large-sized liquid droplets at the same spraying amount of the solution because larger numbers of liquid droplets can be secured.

Therefore, in the present invention, sprayed liquid droplets of water or aqueous solution are passed through a mesh-like high-voltage charged electrode which is electrically charged with a high voltage of −1 to −50 kV, thereby charging liquid droplets of the water or aqueous solution with static electricity, which results in binding of liquid droplets to the steel sheet via electrical attraction therebetween. Since use of the mesh-like charged electrode results in a uniform electrical field formed by the charged electrode, effects by a high voltage are more effective. When the liquid droplets of water or aqueous solution pass through the mesh-like high-voltage charged electrode, electrostatic atomization occurs and large-sized liquid droplets are finely divided into small-sized liquid droplets, thus resulting in a decreased average size of liquid droplets and increased numbers thereof. In addition, small liquid droplets as well as large liquid droplets are bound to the steel sheet via electrical attraction therebetween, thereby improving binding efficiency and therefore it is possible to diminish a size of the coating texture.

Further, since water or aqueous solution liquid droplets are bound to the steel sheet via electrostatic attraction therebetween, occurrence of pitting caused by impingement of large liquid droplets having large momentum against the zinc-galvanized layer in a molten state is prevented and as a result, damage to surface appearance of the steel sheet is prevented.

As the applied voltage is higher, such effects are pronounced. However, where the voltage is less than −1 kV, coarse zinc grains are formed. An excessive increase in voltage may cause occurrence of electrical sparks between the charged electrode and steel sheet and therefore it is preferred to use a voltage of not more than −50 kV. At this time, high voltage may be applied by DC, pulse, or DC with addition of a high voltage pulse. Preferably, the high voltage pulse has a frequency of not more than 1000 Hz. Where frequency is higher than 1000 Hz, binding efficiency-improving effects possessed by the high voltage pulse are not exerted, thus failing to obtain effects of using an expensive pulse generator.

Further, upon spraying the aqueous solution on the steel sheet, liquid droplets of water or aqueous solution are preferably sprayed by two-fluid spray nozzle. This is because use of the two-fluid spray nozzle is preferred in atomization of liquid droplets.

In addition, as a solute dissolved in the sprayed aqueous solution, it is effective to use the solute that can promote formation of solidification nuclei on the coating layer. As the solute that can serve as solidification nuclei, it is preferred to use phosphate. That is, an aqueous phosphate solution in which phosphate is dissolved in water may be used.

Where phosphate is used as the solute of the aqueous solution, droplets of the aqueous phosphate solution bound to the surface of the steel sheet take away latent heat of the steel sheet by decomposition of phosphoric acid in combination with water evaporation. $P_2O_5$ compounds remaining on the surface of the steel sheet serve as solidification nuclei, and the coating layer proceeds to solidify from around those solidification nuclei. Since about one solidification nucleus forms one spangle, smaller droplets of the aqueous solution at the same spray amount thereof lead to increased density of solidification nuclei and are thus advantageous for production of a spangle-free hot-dip galvanized steel sheet. Therefore, the hot-dip galvanized steel sheet in accordance with the present invention can be advantageously produced by a method of spraying the aqueous phosphate solution having a proper concentration of phosphate in order to further accelerate creation of solidification nuclei in the solidification reaction.

There is no particular limit to kinds of phosphates and conventional phosphates may be used. Examples of phosphates that can be used in the present invention may include ammonium hydrogen phosphate, ammonium calcium phosphate and ammonium sodium phosphate. In addition, a concentration of phosphate in the aqueous solution is preferably in a range of 0.01 to 5% by weight in terms of phosphoric acid. Where the concentration of phosphoric acid is less than 0.01% by weight, it is undesirable due to no effects of phosphate used. In contrast, where the concentration of phosphoric acid exceeds 5% by weight, it is undesirable because of the possibility to cause plugging of a spray nozzle by the phosphate compound which is present in a particulate state without being dissolved.

Even though the amount of phosphate in the aqueous solution, necessary to obtain the coating texture proposed by the present invention, may be varied depending on latent heat possessed by the steel sheet, the amount of phosphate is preferably in a range of 0.1 to 500 mg/m$^2$ in terms of phosphorus bound to the surface layer portion of the steel sheet. Where the content of phosphate is less than 0.1 mg/m$^2$, the binding amount of phosphorus which plays an important role in creation of solidification nuclei is too small, thereby leading to failure in micronization of the coating texture. In contrast, where the content of phosphate exceeds 500 mg/m$^2$, the binding amount of phosphorus is too large, thereby resulting in high risk of adverse effects on phosphate treatment performance in a painting process of motor vehicles. The amount of phosphorus bound to the surface layer portion of the steel sheet is controllable by adjusting the content of phosphate in the solution and the spray amount of the aqueous solution.

Meanwhile, in continuous zinc-galvanization lines, there are flows of fluid due to numerous factors, which prevents binding of liquid droplets, such as air current moving along with the steel sheet upon movement thereof, a rising current of air ascending from a high-temperature hot-dip galvanization pot, and air current resulting from a high-temperature of the steel sheet. Smaller liquid droplets are significantly affected by such air currents, leading to difficulty in binding thereof to the steel sheet. Therefore, in order to overcome such disadvantages, it is necessary to control spray pressure of water or aqueous solution and air and a ratio between pressure of water or aqueous solution and air pressure.

For such reasons, it is preferred to ensure that upon spraying, pressure of water or aqueous solution is in a range of 0.3 to 5 kgf/cm$^2$, air pressure is in a range of 0.5 to 7 kgf/cm$^2$ and a ratio of the pressure of water or aqueous solution/air pressure is in a range of 1/10 to 8/10. Where the pressure of water or aqueous solution is less than 0.3 kgf/cm$^2$, there is no atomizing effects of a particle size of zinc crystals. Where the pressure of water or the aqueous solution exceeds 5 kgf/cm$^2$, it is undesirable in that surface appearance of the steel sheet is damaged due to occurrence of pitting marks caused by collision of liquid droplets of the solution on the surface of the steel sheet.

Meanwhile, where air pressure is less than 0.5 kgf/cm$^2$, this may undesirably lead to difficulty in binding of liquid droplets of the sprayed solution to the steel sheet due to excessively low spray pressure. In contrast, where air pressure exceeds 7 kgf/cm$^2$, the kinetic energy of sprayed liquid droplets is too large and this undesirably results in occurrence of pitting marks wherein the surface of the coating layer is hollowed by liquid droplets, thereby causing damage to surface appearance of the coating layer.

Where a ratio of water or aqueous solution pressure/air pressure is less than 1/10, the solution is not sprayed, thereby failing to exert micronizing effect of the coating texture. In contrast, where a ratio of water or aqueous solution pressure/air pressure exceeds 8/10, drop marks occur, which then results in damage to surface appearance.

By installing air curtains at the bottom of a solution spray bath to block air currents ascending from a molten zinc bath, it is preferred to constantly maintain flowing condition of the solution spray bath if possible while simultaneously keeping the steel sheet at the constant temperature upon spraying the solution. In addition, as liquid droplets falling from the solution spray bath to a coating bath are removed by the air which is blown into the air curtain, the air curtain eliminates liquid droplets falling from the spray bath to the coating bath. Consequently, the air curtain serves to block liquid droplets falling to the coating bath from the solution spray bath.

When liquid droplets bind to the steel sheet, water evaporates in the form of vapor. In addition, a portion of water or aqueous solution liquid droplets, which were not bound to the steel sheet, are removed by suction hoods installed at the top of the solution spray bath and therefore it is possible to ensure pleasant working conditions.

The hot-dip galvanized steel sheet prepared by the method of the present invention has a particle diameter of zinc crystals of a coating layer ranging from 10 to 88 ㎛ and shows no solidification traces of dendrites upon observing under a microscope at a magnification of 100×. These results are believed to be due to the fact that liquid droplets bound to the steel sheet serve as solidification nuclei, thus leading to increased density of solidification nuclei, and consequently a particle diameter of zinc crystals becomes small and solidification is completed under conditions at which dendrites did not develop and grow. Because solidification is completed under conditions at which dendrites failed to develop, crystal orientation according to respective zinc grain is maintained at almost the same state, thereby providing uniform electrochemical properties as compared to when dendrites are present.

In addition, as a zinc crystal particle diameter of the coating layer becomes finer, a difference in height between hills ("↗",) and valleys (凹) on the surface of the coating layer is reduced and as a result, an arbitrarily selected circular area having a radius of 5 mm on the surface of the steel sheet exhibits a height difference between hills and valleys formed in the coating layer, which is less than 25% of a coating thickness.

Meanwhile, under conventional solidification conditions, aluminum is not present at the grain boundaries but is present in the interior of grains. However, if creation of solidification nuclei is accelerated and growth of dendrites is inhibited by the method of the present invention, solidification of the zinc-galvanized layer is terminated toward the surface layer portion thereof and progresses in a direction parallel to the surface of the steel sheet, thereby resulting in segregation of aluminum near the grain boundaries.

The above hot-dip galvanized steel sheet of the present invention having properties similar to those of electroplated materials and the method of manufacturing the same provide superior corrosion resistance, oil stain resistance and blackening resistance, and favorable surface appearance. Therefore, such a steel sheet can be used as a material for use in inner and outer plates of car body, household electric appliances and building materials and steel sheet for painting. In the method of manufacturing the hot-dip galvanized steel sheet in accordance with the present invention, there may be used a device for manufacturing a hot-dip galvanized steel sheet, comprising a pair of air knives positioned over a zinc-coating bath to control a coating amount of a plated steel sheet; one or more water or aqueous solution spray nozzles positioned toward the steel sheet in a spray bath over air knives; and a mesh-like charged electrode positioned between the spray nozzle and steel sheet. FIG. 6 is a schematic view showing a hot-dip galvanization device in accordance with the present invention. As shown in FIG. 6, upon hot-dip galvanization, a steel sheet 2 is dipped in a coating bath 1, and the steel sheet 2 is then passed through a sink roll 3 and a stabilization roll 4 in the coating bath 1 and is provided to a spray bath 6. The sink roll 3 serves to divert a direction of the steel sheet introduced into the coating bath 1, and the stabilization roll 4 serves to fix the steel sheet 2 so as not to be shaken when it is introduced into the spray bath 6.

The spray bath 6 is located at an appropriate position over air knives 5. The appropriate position is restrained by hot-dip galvanization conditions and limitations of steel sheet temperature upon spraying, and the appropriate position of the spray bath 6 may be optimally determined by those skilled in the art, taking into consideration the above-mentioned factors. For example, as a thickness of the steel sheet, line speed and/or coating amounts increase, the distance between the spray bath and air knives becomes more distant. The steel sheet 2 is air-wiped at air knives 5, thereby controlling an amount of molten zinc bound to the steel sheet 2.

Spray nozzle 7 and charged electrode 8 are placed inside the spray bath 6. The spray nozzle 7 is placed at a suitable distance from the steel sheet 2 such that the spray nozzle 7 is directed toward the steel sheet 2. The spray nozzle 7 may be one or more and two-fluid spray nozzle is preferred as mentioned hereinbefore. Charged electrodes 8 are placed between the steel sheet 2 and spray nozzle 7 such that charged electrode 8 is directed toward faces of the steel sheet 2.

By having such an arrangement, as liquid droplets of water or aqueous solution sprayed through spray nozzle 7 pass through a mesh-like high-voltage charged electrode 8 which is electrically charged with a high voltage, the liquid droplets are electrostatically charged and thereafter may be bound to the steel sheet 2. The charged electrode 8 may be one or more. In addition, a distance between the steel sheet 2 and mesh-like charged electrode 8 should be shorter than a distance between the spray nozzle 7 and charged electrode 8. By fabricating to have such arrangement, an electrical field may be effectively formed between the charged electrode 8 and steel sheet 2 and binding efficiency of liquid droplets is increased.

Further, air curtains 9 are additionally installed at the bottom of the spray bath 6 so as to block air currents ascending from the hot-dip galvanizing bath 1, such that flowing condition of the spray bath 6 is constantly maintained if possible while simultaneously keeping the steel sheet at constant temperature upon spraying the solution. Air curtains 9 also block liquid droplets falling to the zinc-coating bath 1 from the solution spray bath 6. Air curtains 9 have slit-like air spray orifices which are parallel to the surface of the steel sheet 2.

Suction hoods 10 are additionally installed at the top of the spray bath 6, in order to prevent sprayed liquid droplets from being scattered into a plant along the steel sheet 2 from the top of the spray bath 6. That is, after liquid droplets are bound to the steel sheet, water which is evaporated in the form of vapor, and a portion of water or aqueous solution liquid droplets which are evaporated without being bound to the steel sheet, are removed by suction hoods 10 located on the top of the spray bath 6 and therefore it is possible to ensure pleasant working conditions.

Mode for the Invention

EXAMPLES

Now, the present invention will be described in more detail with reference to the following examples. These examples are provided only for illustrating the present invention and should not be construed as limiting the scope and spirit of the present invention.

Example 1

A steel sheet having a thickness of 0.8 mm was air-wiped under conditions of moving at 80 m/min in a hot-dip galvanizing solution bath composed of a composition containing impurities including Fe which is unavoidably present and 0.18% by weight of aluminum (Al), such that zinc was bound to the steel sheet in the sum of 140 g/m$^2$ for both sides of the steel sheet. Then, an aqueous solution of ammonium hydrogen phosphate ($NH_4(H_2PO_4)$) was sprayed on the surface of the steel sheet via a two-fluid spray nozzle to impart solidification nuclei, thereby preparing a coating layer. A mesh-like high-voltage charged electrode is disposed between the two-fluid spray nozzle and steel sheet, such that the aqueous solution of ammonium hydrogen phosphate passed through the spray nozzle was bound to the steel sheet via the charged electrode. Coating was carried out by installing air curtains at the bottom of the spray nozzle and installing suction hoods at the top of the spray bath.

Here, a deviation in binding amounts of the coating layer was 10%. Solidification conditions of the coating layers in Examples 1 through 7 and Comparative Examples 1 through 14 were varied as set forth in Table 1 below. Grain sizes of zinc and solidification traces of dendrites were observed for the coating layers formed by the above-mentioned hot-dip galvanization. The results thus obtained are given in Table 1 below.

The grain size of the zinc was determined by a method involving magnifying a surface area of a specimen having a size of 10 mm×10 mm to 100× and measuring the number of total crystalline zinc grains contained in that area. Traces of dendrites were observed under a microscopy at a magnifying power of 100×. Upon application of a voltage, the sum of a DC voltage and a high voltage pulse are set to be a target voltage. Here, voltage strength of DC and AC was the same. The applied frequency of the high voltage pulse was 100 Hz.

TABLE 1

| | | Conc. of phosphate (1) (wt %) | Content in surface layer portion of coating layer (mg/m$^2$) | Applied high-voltage (KV) | Spray pressure: Water or aqueous solution (kgf/cm$^2$) | Spray pressure: Air (kgf/cm$^2$) | Spray pressure: (Water or aqueous solution/air) ratio | Solution-spray steel sheet temperature (initiation-completion) (° C.) | Characteristics of coating texture: Coating texture size (μm) | Characteristics of coating texture: Traces of dendrites/ others |
|---|---|---|---|---|---|---|---|---|---|---|
| Examples | 1 | 0.5 | 1 | −50 | 0.3 | 0.5 | 0.6 | 420-417 | 80 | None/ |
| | 2 | 0.1 | 300 | −30 | 1.8 | 3 | 0.6 | | 30 | None/ |
| | 3 | 5 | 30 | −1 | 1.8 | 3 | 0.6 | | 70 | None/ |
| | 4 | 0.5 | 500 | −20 | 5 | 7 | 0.71 | | 20 | None/ |
| | 5 | 0.5 | 100 | −20 | 1.8 | 3 | 0.6 | | 40 | None/ |
| | 6 | 2 | 0.1 | −30 | 0.6 | 6 | 0.1 | | 80 | None/ |
| | 7 | 3 | 200 | −10 | 4 | 5 | 0.8 | | 30 | None/ |

TABLE 1-continued

| | | Conc. of phosphate (1) (wt %) | Content in surface layer portion of coating layer ($mg/m^2$) | Applied high-voltage (KV) | Spray pressure: Water or aqueous solution ($kgf/cm^2$) | Spray pressure: Air ($kgf/cm^2$) | Spray pressure: (Water or aqueous solution/air) ratio | Solution-spray steel sheet temperature (initiation-completion) (° C.) | Characteristics of coating texture: Coating texture size (μm) | Characteristics of coating texture: Traces of dendrites/ others |
|---|---|---|---|---|---|---|---|---|---|---|
| Comparative Examples | 1 | 0.6 | <0.1 (trace) | 0.5 | 0.5 | 3 | 0.17 | 423-419 | 150 | Found/ |
| | 2 | 0 | <0.1 (trace) | −50 | 5 | 7 | 0.71 | | 200 | Found/Pitting marks |
| | 3 | 0.5 | <0.1 (trace) | 0 | 1.8 | 3 | 0.6 | | >200 | Found/ |
| | 4 | 0.5 | 300 | −60 | 1.8 | 3 | 0.6 | | 30 | None/Arc generated |
| | 5 | 0.5 | 600 | −20 | 6 | 8 | 0.75 | | 30 | None/Pitting marks |
| | 6 | 0.5 | 550 | −20 | 1.8 | 1.7 | 0.6 | | 80 | Slightly/Drop marks |
| | 7 | 0.5 | <0.1 (trace) | −20 | 1.8 | 3 | 0.6 | 417~415 | >200 | Found/ |
| | 8 | 6 | 700 | −20 | 1.4 | 3.0 | 0.47 | 420~418 | 40 | None/Nozzle plugged |
| | 9 | 0.5 | 0.05 | −15 | 0.3 | 0.4 | 0.8 | 420~418 | 100 | Found/ |
| | 10 | 0.7 | <0.1 (trace) | −30 | 0.2 | 0.8 | 0.25 | 420~418 | >200 | Found/ |
| | 11 | 0.7 | <0.1 (trace) | −20 | 0.2 | 1 | 0.2 | 420~418 | >200 | Found/ |
| | 12 | 0.7 | 600 | −20 | 3 | 8 | 0.375 | 420~418 | 50 | None/Pitting marks |
| | 13 | 0.7 | 600 | −30 | 5 | 6 | 0.83 | 420~418 | 40 | None/drop marks |
| | 14 | 0.7 | <0.1 (trace) | −30 | 0.5 | 6 | 0.08 | 420~418 | 200 | Found/ |

(1) Concentration of phosphate refers to a concentration in terms of phosphoric acid in the aqueous solution.

Examples 1 through 7 shows the results obtained when steel sheets were treated in specified ranges of the present invention, and it was possible to obtain coating textures in accordance with the present invention. As a high-voltage is increased, the concentration of phosphate is increased and spray pressure is increased, further micronized zinc grains can be obtained.

Comparative Example 1 shows the results obtained when a high-voltage is low and it can be seen that a coarse texture was formed. In Comparative Example 2, high air pressure was used and it can be seen that kinetic energy of sprayed liquid droplets was too large and thereby liquid droplets caused occurrence of pitting marks, thus resulting in hollowing of the coating layer surface. Comparative Example 3 corresponds to when a high voltage was not applied, thus representing that coarse coating texture was formed similar to Comparative Example 1. Comparative Example 4 corresponds to when a high voltage exceeds the specified range of the present invention, and the results show that a fine coating layer was formed at an early stage, but there was a risk of fire in hot-dip galvanization facilities due to occurrence of electric arc during coating operations. In Comparative Example 5, high-spray pressure of the aqueous solution and air was used and pitting marks were occurred similar to Comparative Example 2. Comparative Example 6 is the case in which water pressure was higher than air pressure. The results shows that an average size of the coating textures was 88 μm, but large solution drops have quenched the coating texture, thus leading to occurrence of drop marks and the coating texture having a size of more than 88 μm has exceeded 10%. Comparative Example 7 is the case in which a temperature of the steel sheet was low upon spraying a solution and the results show that a size of the coating texture was large and traces of dendrites were observed. Comparative Example 8 is the case in which a concentration of phosphate was high and the results show that prolonged operation has resulted in clogging of a nozzle. Comparative Examples 9 through 11 correspond to when spray pressure of aqueous solutions was low and the results show that there were no micronizing effects of the zinc grain. Comparative Example 12 is the case in which air pressure was high and the results show that occurrence of pitting marks was observed similar to Comparative Example 2. Comparative Example 13 is the case in which a ratio of a solution : air pressure exceeded a limited range. The results show that the coating texture having a size of 40 μm was obtained and the coating texture having a size of not less than 88 μm was also less than 10%, but occurrence of drop marks was observed. Comparative Example 14 is the case in which a ratio of a solution : air pressure was below a limited range, and the results show that micronizing effects of the coating texture were not observed due to failure of solution spraying.

Example 2

For the cases in which there were no problems associated with surface appearance and workability among Examples 1 through 7 and Comparative Examples 1 through 14, a coating thickness, a size of coating texture, the presence/absence of traces of dendrites, a ratio of difference in a height between hills and valleys in a coating layer, segregation of aluminum, corrosion resistance, blackening resistance and oil stain resistance were evaluated. The results thus obtained are given in Table 2 below. Corrosion resistance, oil stain resistance and blackening resistance were evaluated according to the following methods.

Corrosion Resistance

Corrosion resistance was determined by a Salt Spray Test. For this purpose, salt water was sprayed on a steel sheet. The Salt Spray Test was carried out according to JIS Z 2371 as follows: salt water was sprayed on a steel sheet under test conditions of a salt concentration: 5±1 wt %, pH: 6.9, temperature: 35±1° C., a spray amount: 1 cc/hr, for 72 hr, followed by evaluating a degree of occurrence of red rust on the surface of the steel sheet.

Oil Stain Resistance

For measuring oil stain resistance, 5% by weight of water was suspended in anti-corrosive oil, BW-90EG (Buhmwoo corporation, Seoul, Korea), and the resulting suspension was applied to a steel sheet. After one day storage of the steel sheet in a hot-air drying furnace at 85° C., a degree of discoloration in appearance thereof was evaluated.

Blackening Resistance

Blackening resistance was evaluated by storing a specimen in a humidity cabinet at 49° C. and relative humidity of 95% for 120 hours and measuring a degree of discoloration of the steel sheet.

As a conventional hot-dip galvanized material which was used as a reference for analyzing effects of the present invention, a steel sheet was used which was obtained by air-wiping the steel sheet having a thickness of 0.8 mm in a hot-dip galvanizing solution bath of Example 1 under conditions of a moving rate of 80 m/min such that zinc was bound to the steel sheet in the sum of 140 g/m$^2$ for both sides of the steel sheet and then solidifying the hot-dip galvanized layer via a air-cooling manner instead of using an aqueous solution-spray manner.

In evaluation of corrosion resistance, blackening resistance and oil stain resistance, respective symbols have the following meanings: ◎: remarkably improved as compared to conventional material; Δ: equivalent to conventional hot-dip galvanized material or a degree of improvement is not significant; and X: level equivalent to conventional hot-dip galvanized material.

TABLE 2

| | | Coating thickness (μm) | Size of coating texture (μm) | Traces of dendrites | Height difference betweenhill and valley/coating thickness | Al segregation (%) | Corrosion resistance | Blackening resistance | Oil stain resistance |
|---|---|---|---|---|---|---|---|---|---|
| Examples | 1 | 10 | 80 | None | 0.20 | 70 | ◎ | ◎ | ◎ |
| | 2 | 8.5 | 30 | None | 0.07 | 80 | ◎ | ◎ | ◎ |
| | 3 | 10 | 70 | None | 0.20 | 70 | ◎ | ◎ | ◎ |
| | 4 | 8 | 20 | None | 0.05 | 80 | ◎ | ◎ | ◎ |
| | 5 | 10 | 40 | None | 0.13 | 60 | ◎ | ◎ | ◎ |
| | 6 | 20 | 80 | None | 0.25 | 50 | ◎ | ◎ | ◎ |
| | 7 | 10 | 30 | None | 0.10 | 60 | ◎ | ◎ | ◎ |
| Comparative Examples | 1 | 10 | 150 | Found | 30 | 30 | X | X | X |
| | 3 | 20 | >200 | Found | 0.50 | 20 | X | X | X |
| | 7 | 10 | >200 | Found | 0.50 | 25 | X | X | X |
| | 9 | 8.5 | 100 | Found | 0.27 | 40 | Δ | Δ | Δ |
| | 10 | 10 | >200 | Found | 0.5 | 20 | X | X | X |
| | 11 | 8.5 | >200 | Found | 0.4 | 20 | X | X | X |
| | 12 | 200 | 150 | Found | 0.3 | 25 | X | X | X |
| | 14 | 10 | 200 | Found | 0.31 | 30 | X | X | X |

As the coating texture becomes finer and the coating thickness is thinner, a ratio of height difference between hills and valleys becomes smaller and a degree of enrichment of aluminum at grain boundaries tends to increase. All of Examples 1 through 7 satisfied limited ranges regarding height difference between hills and valleys/coating thickness ratio and aluminum segregation, and exhibited superior corrosion resistance, blackening resistance and oil stain resistance.

In Comparative Examples 1, 3, 7, 9 to 12 and 14, corrosion resistance, blackening resistance and oil stain resistance of the zinc-galvanized steel sheet were not satisfactory, surface unevenness of the coating layer were severe and there was no tendency for preferred segregation of aluminum at grain boundaries.

Example 3

In this example, a size of zinc crystals and the presence/absence of dendrites in coating layers of Examples and Comparative Examples were examined.

Micrographs (100×) of hot-dip galvanized steel sheet obtained in Example 5 and Comparative Examples 3 and 9 are shown in FIGS. 1*a*, 1*b* and 1*c*, respectively.

As can be seen from FIG. 1*a* (A), an average particle diameter of zinc crystals in the plating layer of the steel sheet obtained in Example 5 was in a range of 10 to 88 μm and formation of dendrites was not observed (top). The bottom of FIG. 1*a* (B) is a graph showing size distribution of coating texture in the coating layer of the steel sheet obtained in Example 5. As can be seen therefrom, zinc crystal particles having a diameter exceeding 88 μm were not more than 10%.

FIG. 1*b* is a surface micrograph of a steel sheet obtained in Comparative Example 3, thus representing that there was development of dendrites in which a diameter of zinc-galvanized texture is not less than 200 μm. F*ig*. 1*c* is a surface micrograph of a steel sheet obtained in Comparative Example 9, thus representing that an average particle diameter of zinc crystals in a hot-dip galvanized layer was 100 μm, and coating texture exceeding 88 μm in a size was greater than 10%. Further, growth of the coating layer into dendrites was also observed.

Example 4

In this example, height differences between hills and valleys of coating layers of hot-dip galvanized steel sheets prepared in a manner of Example 5 and Comparative Example 3 were measured. As a measuring apparatus, the three-dimensional surface profilometer (WYCO, USA) was used. In FIGS. 2*a* and 2*b*, the horizontal axis (X-axis) represents a distance in a direction of width on the surface of the steel sheet, and the axis of ordinates (Y-axis) represents a height at a position of the horizontal axis (X-axis). FIG. 2*a* corresponds to Example 5, and represents that a height difference between the highest point and the lowest point is within 1 μm, and at this time, upon considering that a thickness of a coating layer is a level of 10 μm (coating amounts for both sides: 140 g)/m$^2$), a height difference between hills and valleys is less than 25% of the coating thickness. FIG. 2*b* is a graph showing results of determination on a height difference between hills and valleys of the coating layer obtained in Comparative Example 3. When it was measured as in the same manner as FIG. 2*a*, the height difference between hills and valleys was not less than 25% of the coating thickness.

Example 5

This example was carried out to examine whether preferred orientation toward (0002) plane of zinc-galvanized layer is maintained after skin-pass rolling of hot-dip galvanized steel sheets under the conditions in which a length of a steel sheet is 1.5% increased by skin-pass rolling, depending on coating layer textures. FIG. 3*a* is a graph showing preferred orientation of (0002) plane of a coating layer obtained in Example 5. Here, preferred orientation of (0002) plane is not damaged even when skin-pass rolling is carried out and therefore preferred orientation prior to skin-pass rolling is maintained. FIG. 3*b* is a graph showing preferred orientation of (0002) plane of coating layer obtained in Comparative Example 7. Here, as an amount of skin-pass rolling is increased, preferred orientation of (0002) plane is broken. These results indicate that skin-pass rolling dose not result in deformation of a coating texture when the coating texture is small. Such phenomena are presumed to be due to the fact that unevenness on the coating layer are small, which leads to less deformation in the coating texture, and also deformation upon skin-pass rolling has occurred along grain boundaries.

Example 6

This example was carried out to measure a degree of segregation of aluminum in coating layers.

FIG. 4*a* is an EM (200×) showing a degree of segregation of aluminum in a coating layer of example 5 (left) and an EM (200×) showing results of analysis on a coating layer of Example 5 using an electron probe micro-analyzer (EPMA) (middle). FIG. 4*b* is an EM (40×) showing a degree of segregation of aluminum in a coating layer of Comparative Example 7 (left) and a photograph (40×) showing results of analysis on a coating layer of Comparative Example 7 using an EPMA (middle).

The electron probe micro-analyzer (EPMA) is an apparatus which is used for plane analysis of certain elements. When the subject element to be analyzed is present on the surface of interest, this apparatus enables confirmation of the presence of such an element by exhibition of different surface colors between an element-free region and element-containing region.

According to the analysis results of FIG. 4*a*(middle) corresponding to Examples of the present invention and FIG. 4*b*(middle), obtained by the EPMA, the region in which aluminum is present is shown brightly, whereas the aluminum-free region is shown darkly.

As used herein, the term "grain boundary' is defined as an area within 5□ in the right and left direction from the line representing boundaries of crystals, as shown in EM of FIGS. 4*a*(left) and 4*b*(left).

A range limited in the present invention is defined as follows. Firstly, as area of a region exhibiting color difference (brightness difference) on photographs upon performing electron probe micro-analysis is analyzed by an image analyzer and the total area of the region exhibiting color difference is calculated. Then, the calculated area is divided by the total area within 5 μm in the right and left directions from the grain boundary as shown in micrographs. Based on these calculations, the value in which the area of a region exhibiting color difference (brightness difference) is greater than 50% is the range limited by the present invention.

Since zinc and aluminum contained in the coating layer, upon solidification, results in eutectic reaction, a higher content of aluminum lowers a solidification point of the coating layer. That is, a zinc alloy, in which a portion of aluminum is contained, results in lowering of the solidification point thereof as compared to pure zinc and upon solidification, proceeds with solidification in a manner that pure zinc is firstly crystallized and then a homogeneous atom, aluminum, is continuously pushed into a liquid phase. As a result, a concentration of aluminum is high in a region where the latest solidification takes place, while a concentration of aluminum is low in a region where solidification takes place first.

From comparison between photographs (left and middle) of FIG. 4*a*, corresponding to a coating layer of Example 5, it can be seen that large amounts of aluminum are segregated at the grain boundaries. In addition, when amounts of aluminum present at the grain boundary were measured by the above-mentioned method, about 60% of aluminum observed on the surface of the coating layer was present at the grain boundaries.

FIG. 4*a*(right) is a side-cross sectional view of a coating layer of Example 5 under solidification, wherein a lower part, which is represented by reference numeral 11, is a steel sheet and an upper part, which is represented by reference numeral 12, is a coating layer under solidification. A solution, which was sprayed toward the surface of the steel sheet, forms large quantities of solidification unclei and increases a cooling rate to accelerate solidification and thereby interfaces between the steel sheet and coating layer and the surface of the coating layer are solidified almost at the same time and grow laterally. In this manner, since the coating layer is solidified almost simultaneously due to a multitude of solidification unclei, zinc is solidified with formation of a narrow grain boundary 13 (see FIG. 4*a*, right). At this time, as the grain boundary 13 undergoes the latest solidification, large quantities of aluminum are segregated at the grain boundary 13, which in turn improves corrosion resistance of an unstable grain boundary, thus resulting in uniform improvement of corrosion resistance through the coating layer.

From comparison between photographs (left and middle) of FIG. 4*b*, corresponding to a coating layer of Comparative Example 7, it can be seen that large amounts of aluminum are segregated in the interior of grains, rather than at the grain boundary.

FIG. 4*b*(right) is a side-cross sectional view of a coating layer of Comparative Example 7 under solidification, wherein a lower part, which is represented by reference numeral 11', is a steel sheet and an upper part, which is represented by reference numeral 12', is a coating layer under solidification. Generally, when the hot-dip galvanized layer is solidified, solidification unclei are created on the interface between the steel sheet and coating layer. Thereafter, growth of dendrites not only progresses laterally but also progresses toward the surface. Particularly, upon growing toward the surface, dendrites grow while consuming molten zinc present therearound. As a result, aluminum is trapped between arms of dendrites, instead of migrating from the initial nucleation sites to the grain boundary and aluminum is not present at the grain boundary but is present in a pool of molten zinc formed between dendrites. Upon observation of such solidification behavior by naked eyes, it can be seen that a solidification pool 14' of molten zinc is formed over a broad area between two crystalline textures or within crystalline textures at the end of solidification (see FIG. 4*b*, right). Via such a solidification process, aluminum is, instead of being enriched at the grain boundary 13, is widely distributed throughout the surface of the coating layer. Upon measuring amounts of aluminum present at the grain boundary by the above-mentioned method, about 25% of aluminum observed on the surface of the coating layer was present at the grain boundary. Consequently, stabilizing effects of aluminum on the grain boundary cannot be achieved, thus resulting in low corrosion resistance.

As described above, a solidification manner of the coating layer in the hot-dip galvanized steel sheet of Example 5 becomes different from that of Comparative Example 7, and due to such a fact, the hot-dip galvanized steel sheet of Example 5 is believed to have superior qualities as compared to Comparative Example 7, as shown in Table 2.

Example 7

This example represents changes blackening resistance of a coating layer with respect to a varying amount of skin-pass rolling. FIG. 5 shows the results of measurement of changes in blackening resistance of steel sheets, when the amount of skin pass rolling is varied for steel sheets of Example 5 and Comparative Example 7. Here, the amount of skin-pass rolling was expressed as a degree of how much a length of the steel sheet was extended by skin-pass rolling. That is, much skin-pass rolling of the steel sheet leads to an extended length thereof. Example 5 exhibits maintenance of satisfactory blackening resistance regardless of the amount of skin pass rolling (see FIG. 5, line 2). Whereas, it can be seen from Comparative Example 7 that blackening resistance of the steel sheet is deteriorated as the amount of skin pass rolling increases (see FIG. 5, line 1). It is believed that the reason why such phenomena occur is because, in the coating texture proposed by the present invention, the preferred orientation of (0002) plane is maintained even when skin pass rolling is performed and therefore it is possible to maintain quality characteristics which were exhibited before skin pass rolling, regardless of skin pass rolling.

A hot-dip galvanized steel sheet having a coating texture in accordance with the present invention exhibits advantages such as superior corrosion resistance, blackening resistance, oil stain resistance, surface friction coefficient and surface appearance. Such a hot-dip galvanized steel sheet is prepared by a manufacturing method disclosed in the present invention. The hot-dip galvanized steel sheet having such superior physical properties in accordance with the present invention can be used for a variety of materials such as inner and outer plates of car body, household electric appliances and building materials and steel sheet for painting.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of manufacturing a hot-dip galvanized steel sheet, comprising:

preparing a steel sheet for hot-dip galvanization;

dipping the steel sheet in a bath of zinc-coating solution containing 0.13 to 0.3% by weight of aluminum;

air-wiping the steel sheet having the coating solution bound thereto, thereby removing an excess of the coating solution;

spraying water or an aqueous solution onto the surface of the air-wiped steel sheet by two-fluid spray nozzles;

using a steel sheet temperature in the range of a hot-dip galvanization temperature to 419° C. as a spray initiation temperature and using a steel sheet temperature in the range of 417° C. to 415° C. as a spray completion temperature;

passing sprayed liquid droplets of water or aqueous solution through a mesh-like high-voltage charged electrode which is electrically charged with a high voltage of −1 to −50 kV applied by DC with an addition of a high voltage pulse; and allowing the electrode-passed liquid droplets to be bound to the surface of the steel sheet and thereby being served as solidification nuclei of molten zinc, wherein, among sprayed liquid droplets, the liquid droplets not bound to the steel sheet are kept from falling into the coating bath by air which is blown into an air curtain and are removed by a suction hood.

2. The method according to claim 1, wherein the spray initiation temperature is a steel sheet temperature in the range of 420° C. to 419° C.

3. The method according to claim 1, wherein the aqueous solution is an aqueous phosphate solution containing 0.01 to 5% by weight of phosphoric acid.

4. The method according to claim 1, wherein surface layer portion of coating layer contain 0.1 to 500 mg/m$^2$ of phosphorus.

5. The method according to claim 1, wherein the liquid droplets are sprayed at a pressure of water or aqueous solution of 0.3 to 5 kgf/cm$^2$, an air pressure of 0.5 to 7 kgf/cm$^2$ and the ratio between the pressure of water or aqueous solution and air pressure is in a range of 1/10 to 8/10.

6. The method according to claim 1, wherein, the high voltage pulse has a frequency of not more than 1000 Hz.

* * * * *